US011993413B2

(12) United States Patent
Schloesser et al.

(10) Patent No.: US 11,993,413 B2
(45) Date of Patent: May 28, 2024

(54) HEAT-SHRINKABLE PACKAGING

(71) Applicant: Diopass Sprl, Jalhay (BE)

(72) Inventors: Frédéric Henry Schloesser, Jalhay (BE); Mireille Paula Fluzin, Spa (BE)

(73) Assignee: Diopass Sprl, Jalhay (BE)

( * ) Notice: Subject to any disclaimer, the term of this patent is extended or adjusted under 35 U.S.C. 154(b) by 180 days.

(21) Appl. No.: 17/636,943

(22) PCT Filed: Aug. 26, 2020

(86) PCT No.: PCT/EP2020/073821
§ 371 (c)(1),
(2) Date: Feb. 21, 2022

(87) PCT Pub. No.: WO2021/037893
PCT Pub. Date: Mar. 4, 2021

(65) Prior Publication Data

US 2022/0274728 A1 Sep. 1, 2022

(30) Foreign Application Priority Data

Aug. 27, 2019 (BE) ..... 2019/5559

(51) Int. Cl.
*B65D 71/08* (2006.01)
*B65B 21/24* (2006.01)
(Continued)

(52) U.S. Cl.
CPC ..... *B65B 61/14* (2013.01); *B65B 21/245* (2013.01); *B65B 41/12* (2013.01); *B65B 53/063* (2013.01);
(Continued)

(58) Field of Classification Search
CPC ..... B65D 71/08; B65D 75/002; B65D 75/56; B65B 21/245; B65B 53/063; B65B 61/02; B65B 61/14; B65B 61/06
(Continued)

(56) References Cited

U.S. PATENT DOCUMENTS 4,700,528 A * 10/1987 Bernard ..... B65B 61/14 53/413
4,815,589 A * 3/1989 Allen ..... B65D 71/506 206/432
(Continued)

FOREIGN PATENT DOCUMENTS

DE 29915989 12/1999
EP 0178142 4/1986
(Continued)

OTHER PUBLICATIONS

Rapport de Recherche Internationale et l'Opinion Écrite [International Search Report and the Written Opinion] Dated Jan. 19, 2020 From the International Searching Authority Re. Application No. PCT/EP2020/073821 and Its Translation of Search Report Into English. (11 Pages).

*Primary Examiner* — Steven A. Reynolds

(57) ABSTRACT

The present invention relates to a heat-shrinkable packaging intended for wrapping a series of containers, comprising a lower portion, an upper portion and lateral portions and having a reinforcement strip arranged transversely to the rows of containers, the packaging according to the present invention comprising at least two perforation lines. The present invention also relates to a method for packaging containers by means of a packaging and to a packaging blank.

17 Claims, 7 Drawing Sheets

(51) Int. Cl.

| | |
|---|---|
| ***B65B 41/12*** | (2006.01) |
| ***B65B 53/06*** | (2006.01) |
| ***B65B 61/02*** | (2006.01) |
| ***B65B 61/06*** | (2006.01) |
| ***B65B 61/14*** | (2006.01) |
| ***B65D 75/56*** | (2006.01) |

(52) U.S. Cl.
CPC ..... *B65B 61/02* (2013.01); *B65B 61/06* (2013.01); *B65D 71/08* (2013.01); *B65D 75/56* (2013.01)

(58) Field of Classification Search
USPC ..... 206/432, 497, 428
See application file for complete search history.

(56) References Cited

U.S. PATENT DOCUMENTS

| | | | | |
|---|---|---|---|---|
| 6,105,776 | A * | 8/2000 | Meilhon | B65D 75/5844 229/87.05 |
| 9,776,780 | B2 * | 10/2017 | Schloesser | B65D 75/002 |
| 2002/0157980 | A1 * | 10/2002 | Sheehan, Jr. | B65D 71/08 206/428 |
| 2009/0266732 | A1 * | 10/2009 | Hartl | B65D 71/08 53/134.1 |
| 2010/0236195 | A1 * | 9/2010 | Kollmuss | B65B 61/14 53/556 |
| 2012/0151879 | A1 * | 6/2012 | Ghezzi | B65D 65/40 53/220 |

FOREIGN PATENT DOCUMENTS

| | | |
|---|---|---|
| EP | 0442111 | 8/1991 |
| WO | WO 2009/038679 | 3/2009 |

* cited by examiner

HEAT-SHRINKABLE PACKAGING

RELATED APPLICATIONS

This application is a National Phase of PCT Patent Application No. PCT/EP2020/073821 having International filing date of Aug. 26, 2020, which claims the benefit of priority of Belgium Patent Application No. 2019/5559 filed on Aug. 27, 2019. The contents of the above applications are all incorporated by reference as if fully set forth herein in their entirety.

FIELD AND BACKGROUND OF THE INVENTION

The present invention relates to the field of packaging and more particularly to shrinkable packaging intended for wrapping a series of containers.

The present invention further relates to a method for packaging containers by means of a packaging.

The present invention also relates to a shrinkable packaging blank.

Shrinkable packaging is a well-known product among manufacturers and consumers. Shrinkable packaging film is extremely versatile in view of the type of items to be packaged or the different sizes of items. Shrinkable packaging is used for packaging food, containers or any other item that can be packaged. Furthermore, shrinkable packaging can wrap all types of items of all sizes, both large and small.

A large number of qualities are also known from shrinkable packaging. It is impermeable in order to protect the packaged items from rain, humidity, condensation or even dust. It is aesthetically pleasing, printed or unprinted, with perfect transparency or with different degrees of opacity, in order to make the packaging attractive to consumers. Lastly, it must be strong in order to withstand various mechanical stresses and to prevent it from tearing during transport, storage in supermarkets or when being moved by consumers.

Often, the most conventional shrinkable packaging for containers includes an additional central handle used for moving the packaging that contains the containers. This type of handle generally consists of a first portion made of transparent or printed plastic for gripping and reinforcing portions to be attached to the packaging.

The presence of such a handle is problematic since it is generally made from a reinforcement of paper, soft cardboard or foam, for example synthetic, which is different from the material of the packaging film, which necessitates a sorting of materials, contradictory to the perspective of optimising recycling. Furthermore, such a handle requires a fitting machine integrated in the production line of shrinkable packaging which is sizeable and costly. Lastly, the additional handle has a significant cost per unit.

Currently, there is a packaging that partially resolves the above-mentioned disadvantages. This packaging is known from document WO2009/038679.

This document discloses a shrinkable packaging intended for wrapping a series of containers, comprising:

a lower portion corresponding to a base, an upper portion, opposite said lower portion and corresponding to a covering of said containers which are arranged in parallel rows with respect to each other, said upper portion comprising a central area and a peripheral area, lateral portions connecting the lower portion to the upper portion, said packaging having a reinforcement strip arranged transversely to the parallel rows of containers.

The shrinkable packaging according to this document comprises a reinforcement strip, which forms a handle, wrapping the containers. The packaging and the reinforcement strip are first put into contact with each other, then an incising step occurs in order to create two slits in the packaging, on both sides of the strip. This allows the consumer to slide their fingers through the slits and grip the handle formed by the film and the strip to move the packaging.

Unfortunately, this type of packaging makes handling difficult. This is because the slits are created after the film and the strip have been assembled, and are therefore likely to be positioned incorrectly, causing poor packaging balance and difficult handling for transport. The slits are created before the heat shrinking of the packaging film and are a sufficient width to allow the fingers of the user to pass through. As a result, they may be deformed during heat shrinking and form packaging that is difficult for handlers or end consumers to handle.

Furthermore, in a shop it is often necessary to quickly move packaging without the risk of undesirable tearing. The known packaging according to this prior document has a risk of tearing in the case of the incorrect positioning of the various elements such as the reinforcement strip or the opening slits. Since the packaging can be weakened, protection of the containers can no longer be guaranteed because its strength is considerably reduced.

Furthermore, this type of packaging is not provided to allow the consumer to easily remove a container, either in a shop or at home. To remove a container from the shrinkable packaging according to this prior document, the user must force the packaging film to tear from the slit to the exterior of the packaging. Since the packaging film has to be very strong, this operation is complex and sometimes impossible, for example for the elderly. This contributes to further deformation of the packaging, which becomes weaker, its strength is critically reduced and it remains very difficult to move without dropping the containers or completely breaking the packaging.

The mess is typically unattractive to the consumer who is no longer attracted to the bottles with a forcibly torn packaging and who will prefer to tear a new packaging to remove the containers. It is therefore easy to understand that the next consumer will also prefer to tear a new packaging since the previous ones have become unattractive, thus creating a mess on supermarket shelves.

Also, during forced tearing of the packaging, pieces of the torn packaging film are scattered on other packaging or on the ground. This forms an unattractive range of packaging for the consumer. This effect is well-known to supermarkets, which have to rely on the work of handlers to tidy the shelves, collect the waste from torn packaging or even collect the packaging that has been completely torn.

Therefore, there is a real need to provide manufacturers, supermarkets, handlers and consumers with a shrinkable packaging that is easy to move, open and remove containers, thus avoiding forced, irregular and undesirable tearing.

To resolve these problems, the present invention provides a shrinkable packaging as indicated above, characterised in that it comprises at least two perforation lines which, in the central area of the upper portion of the packaging, are arranged in parallel to each other on both sides of the reinforcement strip, and which, in the peripheral area of the upper portion of the packaging, each progressively diverge from the reinforcement strip.

For the purposes of the present invention, the term "central area" means the surface of the upper portion corresponding to a covering which is substantially parallel to the lower portion corresponding to a base. In other words, the central area is located in a plane substantially in parallel to the plane of the lower portion corresponding to the base of the packaging.

For example, in the case of bottle-type containers, the central area of a packaging according to the invention is an area which extends from the centre of the upper portion to the outer ends of the necks, collars, caps and other closures of containers.

For the purposes of the present invention, the term "peripheral area" means the surface of the upper portion, which is peripheral and substantially oblique in relation to said central area. In other words, the peripheral area as a whole is located in a plane intersecting the plane of the central area and the plane of the lower portion corresponding to a base.

For example, in the case of bottle-type containers, the peripheral area of the packaging according to the invention is an area which extends from the outer end of the necks, collars, caps and other closures of containers to the body portions of the containers, for example the shoulder portions of bottle-shaped containers.

SUMMARY OF THE INVENTION

The packaging according to the present invention allows a two-step opening.

In a first step, the user, the storekeeper, the handler can break the two perforation lines arranged on the central area by pushing the fingers of a hand on both sides of the reinforcement strip, creating said handle, thus allowing the packaging to be moved easily.

It has thus become apparent according to the present invention, and in a particularly advantageous manner, that providing a shrinkable packaging comprising at least two perforation lines which, in the central area of the upper portion of the packaging are arranged parallel to each other on both sides of the reinforcement strip, allows movement of the packaging to be simplified.

In a second step, the two perforation lines arranged on the peripheral area are broken in order to allow the shrinkable packaging to be opened and the containers to be removed in a simple and easy manner, without requiring insurmountable physical efforts.

Providing a shrinkable packaging according to the invention comprising at least two perforation lines which, in the peripheral area of the upper portion of the packaging, progressively diverge from the reinforcement strip, thus allows a simplified and easy opening of the packaging and consequently an easier removal of the containers by avoiding forced, irregular and undesirable tearing.

The shrinkable packaging according to the invention therefore provides a packaging with the two functionalities desired by users, handlers, manufacturers and supermarkets during the first step of storing and moving the packaging and by consumers when opening the packaging at home or elsewhere.

In fact, the at least two perforation lines arranged on the central area, when broken, create a first opening for the fingers of the user to pass through in order to grip the handle formed by the reinforcement strip and the packaging film according to the present invention.

Furthermore, the formation of the first opening from the two perforation lines arranged on the central area allows the packaging to retain its strength even after they have been broken, allowing it to retain a similar shape to the original one and limiting deformations and the risk of accidental tearing during movement.

The presence of the two perforation lines which, in the peripheral area of the upper portion of the packaging, progressively diverge from the reinforcement strip, makes it possible to provide a packaging according to the present invention with a second guided and facilitated opening for the removal of the containers. In fact, when broken, the user can easily, in a guided and precise manner, open the shrinkable packaging in order to remove the containers, without forced or irregular tearing and thus avoiding the formation of undesirable packaging waste which may litter the ground and without requiring considerable efforts to access the containers.

In a preferred embodiment according to the present invention, said reinforcement strip comprises a tackifier by which it is attached to an inner surface of said shrinkable packaging wrapping the series of containers.

In fact, the reinforcement strip provided with a tackifier allows it to be applied in a fixed and precise manner to the packaging while limiting the risks of undesirable movements thereof.

Furthermore, the reinforcement strip, by being attached to an inner surface of the packaging and by wrapping the containers, increases the overall strength of the packaging such that the overall strength is the sum of the strength of the strip and the strength of the packaging itself. This allows the packaging to be more resistant to tearing or breaking when moved using the handle.

It is understood that the adhesive reinforcement strip can also be attached to an outer surface of the packaging or that it can even be provided integrated into the body of the packaging film at the time of manufacture.

In a variant according to the present invention, said packaging and said reinforcement strip are at least 80%, preferably at least 85%, preferably at least 90%, most preferably at least 95% a similar material.

Indeed, the packaging and the reinforcement strip according to the present invention, by being a similar material, take into account recycling constraints, facilitate it and consequently avoid an additional step of sorting materials.

Advantageously, said reinforcement strip according to the present invention has a width of between 1 cm and 7 cm, preferably between 2 cm and 7 cm, preferably between 2 cm and 6 cm, preferably between 3 cm and 6 cm, advantageously between 4 cm and 6 cm.

Advantageously, according to the present invention, said at least two perforation lines are each interrupted by at least one imperforate gap having a predetermined length.

In a preferred embodiment according to the present invention, said at least two perforation lines have perforations spaced apart from each other by at least one space having a predetermined length, and wherein said at least one imperforate gap is at least 1.5 times longer than said gap between perforations, preferably at least 2 times longer, and preferably at least 2.5 times longer than that gap between perforations.

By being interrupted by at least one imperforate gap, the two perforation lines are more resistant to accidental opening. Indeed, the opening of the packaging according to the present invention is advantageously performed in two steps as shown previously. The first step of opening the perforation lines located on the central area creates the handle for moving the packaging. The presence of an imperforate gap, preferably located at the junction of the central area and the peripheral area, creates a stop after this first opening step and prevents unintentional tearing of the perforations located on the peripheral area. The second step of opening the perforation lines located on the peripheral area then allows, in a voluntary and easy manner, the opening of the packaging and the easy removal of the containers.

In another embodiment of the present invention, said at least two perforation lines, in the central area of the upper portion of the packaging can comprise at least one initiator portion, thereby facilitating the breaking thereof. The two perforation lines, in the central area are therefore arranged substantially parallel to each other on both sides of the reinforcement strip.

In an embodiment according to the present invention, said containers are selected from the group consisting of bottles, tins, jars, cans for liquids, cartons and cans. The bottles can be glass, plastic, PET, HDPE, PVC, PP, PC or PLA. The jars can be glass, plastic or metal. The cans for liquids can be cardboard or tetrapack®.

Advantageously, according to the present invention, a row of containers contains two, three or four containers.

Other embodiments of the shrinkable packaging according to the present invention are mentioned in the appended claims.

The present invention also relates to a method for packaging containers by means of a packaging according to the present invention, comprising the steps of:

- feeding a shrinkable film onto at least one conveyor belt along a determined direction of movement,
- arranging said containers on said at least one conveyor belt provided with said shrinkable film, said containers being arranged in rows in parallel to each other, said rows being arranged perpendicularly to said direction of movement of the film,
- shrink wrapping said containers with said shrinkable film forming a shrinkable film packaging around said containers, and
- heat-shrinking said shrinkable film containing said containers, to hold said containers tightly together,
- positioning a reinforcement strip on said shrinkable film, in parallel to said film feeding direction of movement.

The method according to the invention is characterised in that it further comprises a step of incising in said shrinkable film at least two perforation lines which, in the central area of the upper portion of the packaging, are arranged parallel to each other, on both sides of the reinforcement strip and which, in the peripheral area of the upper portion of the packaging, each progressively diverge from the reinforcement strip.

It has become particularly advantageously apparent that the method according to the present invention provides a shrinkable packaging to be opened in two steps, with the formation of a handle allowing simplified movement and then the formation of one or more openings in the packaging allowing easy removal of the containers is facilitated, avoiding forced, irregular and undesirable tearing.

Advantageously, according to the method of the present invention, the feeding comprises unwinding the shrinkable film from a feed roll and positioning of the reinforcement strip occurs on the shrinkable film before said feeding step, on a surface of the film that forms an inner surface of said packaging after shrink wrapping.

The positioning of the reinforcement strip on the inner surface of the shrinkable film advantageously provides a shrinkable packaging with greater mechanical strength and resistance to the stresses occurring during handling and movement.

In an advantageous embodiment, the method according to the invention further comprises at least one step of cutting the shrinkable film which occurs after said positioning of the reinforcement strip and before said feeding step.

In another particularly advantageous embodiment of the method according to the invention, said incising step occurs before feeding said shrinkable film onto the conveyor belt.

Advantageously, said incising step of the method according to the invention occurs before said unwinding of the shrinkable film from said feed roll.

For example, according to the method of the present invention the step of incising the two incision lines occurs before the unwinding of the shrinkable film. The step of positioning the reinforcement strip occurs after the unwinding of the shrinkable film and before the step of positioning the containers. This advantageously allows the reinforcement strip to be perfectly positioned relative to the incision lines and therefore to have a balanced, easily handled and moveable final shrinkable packaging.

Advantageously, said method according to the present invention further comprises at least one step of printing at least one pattern on said film before and/or after said feeding step.

In a variant of the method according to the present invention, said at least one printing step occurs before and/or after said step of incising the shrinkable film.

Other embodiments of the method according to the invention are mentioned in the appended claims.

The present invention further relates to a shrinkable packaging blank for shrink wrapping a series of containers, based on a rectangular shrinkable film having two short sides in width and two long sides in length.

The shrinkable packaging blank according to the present invention is characterised in that it has a reinforcement strip which extends between the two short sides halfway between the two long sides and also, at the centre of the blank, at least two perforation lines which are arranged parallel to each other on both sides of the reinforcement strip, and which, at each end thereof, progressively diverge from the reinforcement strip.

Other embodiments of the packaging blank according to the invention are mentioned in the appended claims.

BRIEF DESCRIPTION OF THE SEVERAL VIEWS OF THE DRAWINGS

Other features, details and advantages of the invention will emerge from the following description, which is non-limiting and refers to the appended drawings.

DESCRIPTION OF SPECIFIC EMBODIMENTS OF THE INVENTION

Figure 1:
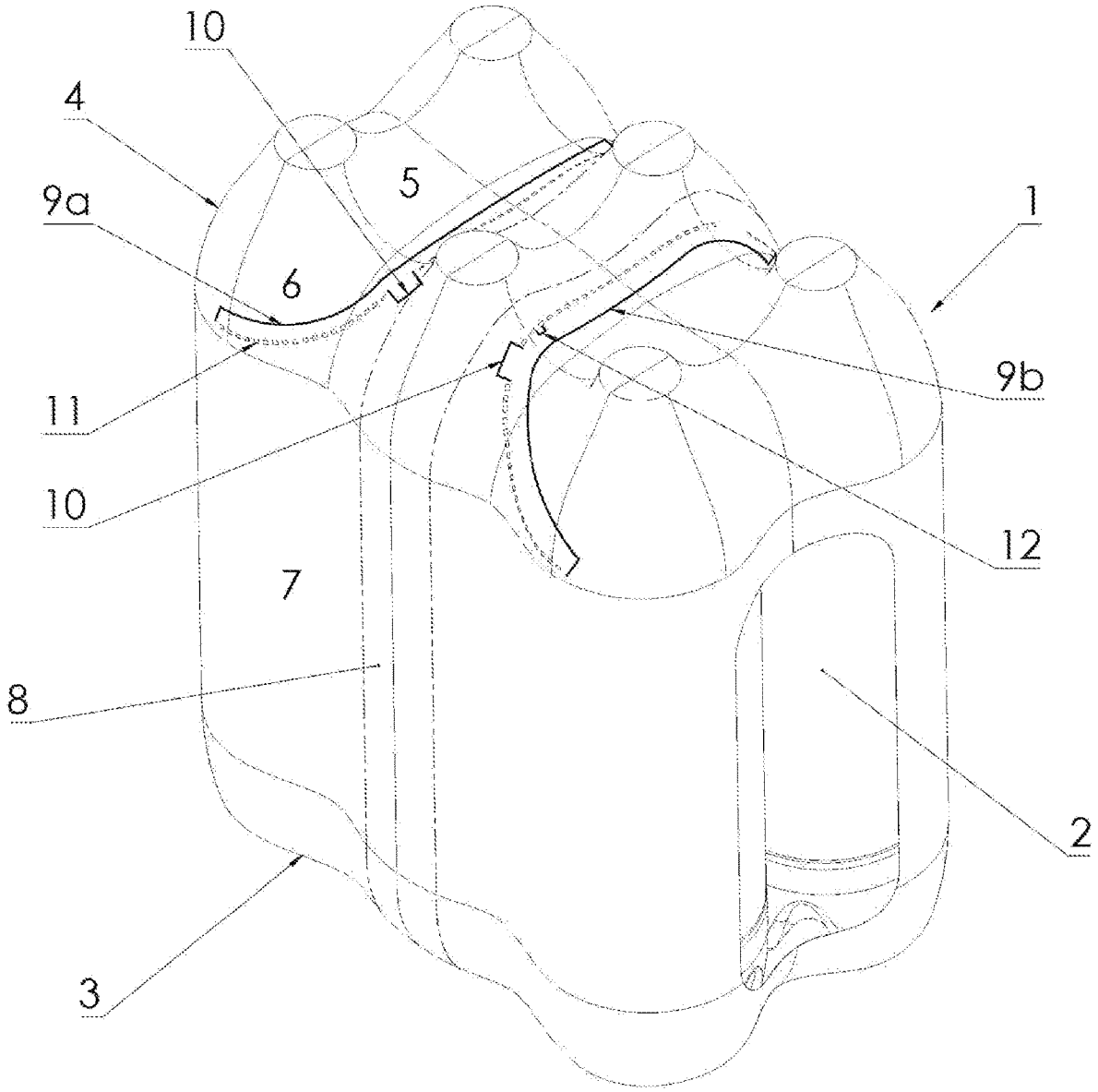
FIG. 1 is a perspective view of a shrinkable packaging according to the invention comprising 6 bottles.
Figure 2:
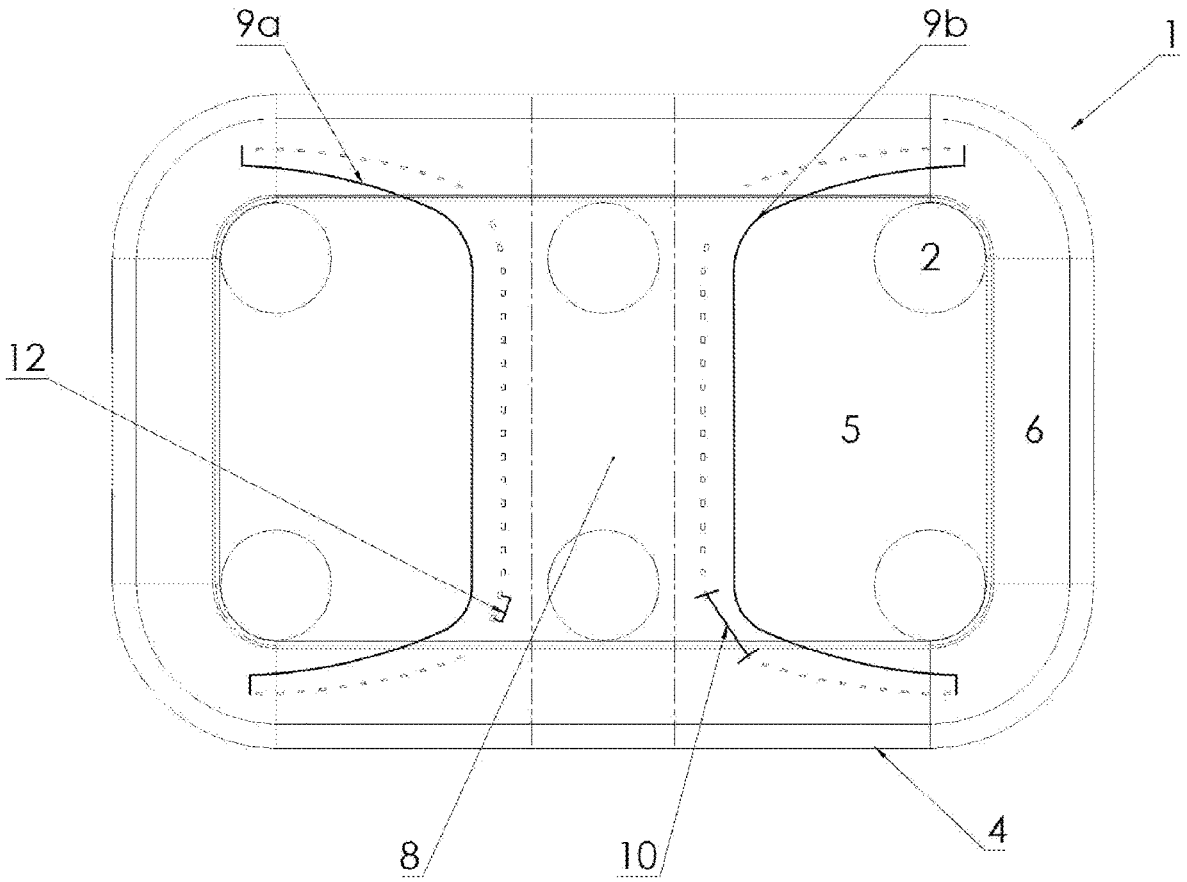
FIG. 2 is a top view of the shrinkable packaging of FIG. 1.

In the figures, identical or similar elements have the same references. It should also be noted that for ease of drawing, only FIG. 1 shows a packaging with the shrinkable film on the packaged bottles. In the following figures, the representation is more schematic.

FIG. 1 shows a shrinkable packaging 1 comprising 6 containers 2. The shrinkable packaging 1 comprises a lower portion 3 corresponding to a base and being located in a first plane. The shrinkable packaging 1 comprises an upper portion 4 which is opposite to the lower portion 3, and which corresponds to a covering of the containers 2, which are arranged in rows in parallel to one another.

The upper portion 4 comprises a central area 5 which is a surface substantially parallel to the lower portion 3 corresponding to a base. Also, the central area 5 is located in a second plane substantially parallel to the first plane of the lower portion 3 corresponding to a base.

The central area 5 of the packaging according to the invention is an area which extends from the centre of the upper portion 4 to the outer ends of the necks, collars, caps and other closures of the containers 2.

The upper portion 4 of a packaging according to the invention comprises a peripheral area 6 which is a surface of the upper portion 4, which is peripheral and substantially oblique relative to the central area 5. Also, the peripheral area 6 as a whole is located in a third plane intersecting the first and second planes of the base portion 3 and the central area 5, respectively.

The peripheral area 6 of a packaging according to the invention is therefore an area which extends from the outer end of the necks, collars, caps and other closures of the containers 2 to the body portions of the containers 2. For example, in the example shown, the peripheral area 6 covers the shoulder portions of the bottle-shaped containers 2.

The shrinkable packaging 1 also comprises lateral portions 7 connecting the lower portion 3 to the upper portion 4. Furthermore, the lateral portions 7 of the packaging 1 cover the body portions of the containers 2.

Furthermore, the shrinkable packaging 1 comprises a reinforcement strip 8 arranged transversely to the parallel rows of the containers 2. In the example shown, the reinforcement strip 8 comprises a tackifier and is arranged to be attached to an inner surface of the packaging 1 wrapping the containers 2. Thus, the reinforcement strip 8 increases the overall strength of the packaging 1 such that the overall strength is the sum of the strength of the reinforcement strip 8 and the strength of the packaging 1 itself. This allows the packaging 1 to be more resistant to tearing or breaking when moved using the handle.

In the example shown, the reinforcement strip 8 is provided with a very small percentage of tackifier, it is therefore considered that the reinforcement strip 8 and the packaging 1 are made of a similar material, which makes it possible to take into account recycling constraints and facilitate this by avoiding an additional step of sorting the materials for recycling the packaging 1 according to the invention.

The reinforcement strip 8 shown has a width of between 2 cm and 6 cm, which makes the packaging 1 more resistant when moved using the handle.

The shrinkable packaging 1 shown comprises two perforation lines 9*a*, 9*b*, shown with a solid line bracket which, in the central area 5 of the upper portion 4 of the packaging 1, are arranged parallel to each other on both sides of the reinforcement strip 8.

In an unillustrated embodiment of the present invention, the two perforation lines 9*a*, 9*b* in the central area 5 of the upper portion 4 of the packaging 1 may comprise at least one initiator portion, thereby facilitating the breaking of the perforation lines 9*a* and 9*b*. They are therefore arranged substantially in parallel to each other on both sides of the reinforcement strip 8.

Figure 3:
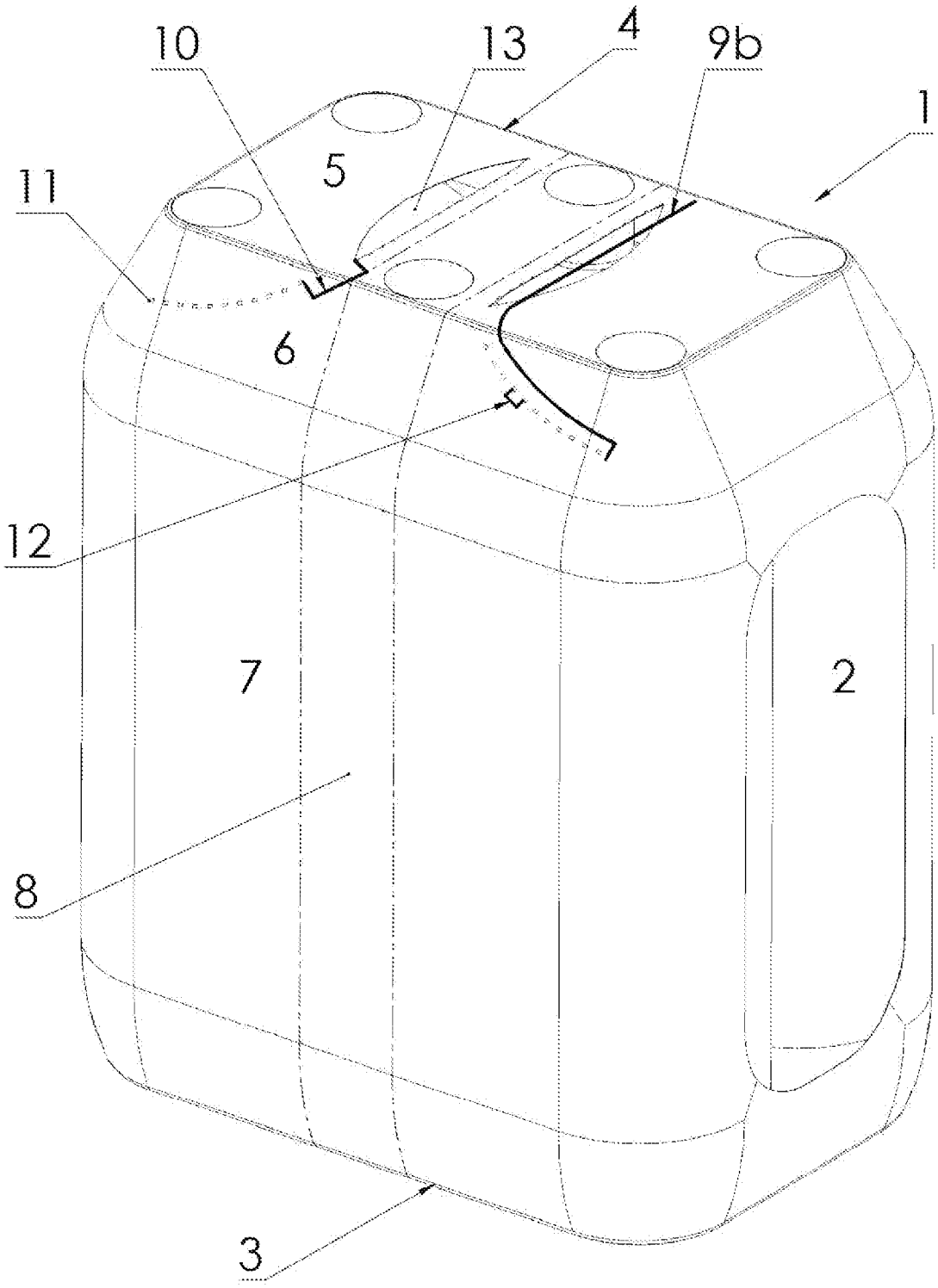
FIG. 3 is a perspective view of a shrinkable packaging according to the invention comprising 6 bottles, after the perforations located in the central area have been broken.
Figure 4:
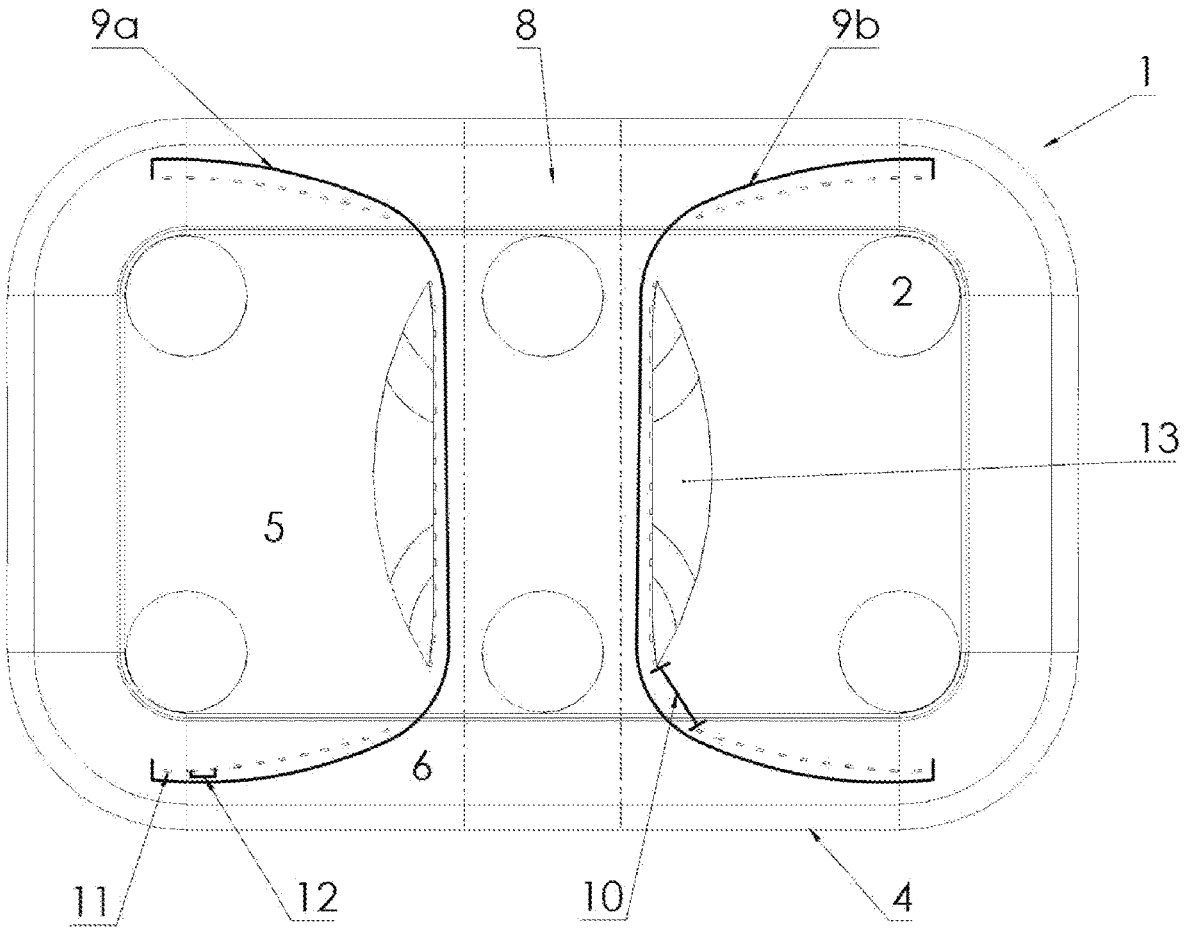
FIG. 4 is a top view of the shrinkable packaging of FIG. 3.

The two perforation lines 9*a* and 9*b* located in the central area 5 of the upper portion 4 of the packaging 1, when broken, create a first opening 13 for the fingers of the user to pass through (see FIGS. 3 and 4). This opening 13 further allows the user to grip the handle formed by the reinforcement strip 8 and the packaging film.

It has become particularly advantageously apparent that, even after the two perforation lines 9*a* and 9*b* have been broken, the shrinkable packaging 1 retains a similar shape and a similar rigidity to the original one, thus limiting the risk of undesirable tearing or deformations.

Figure 5:
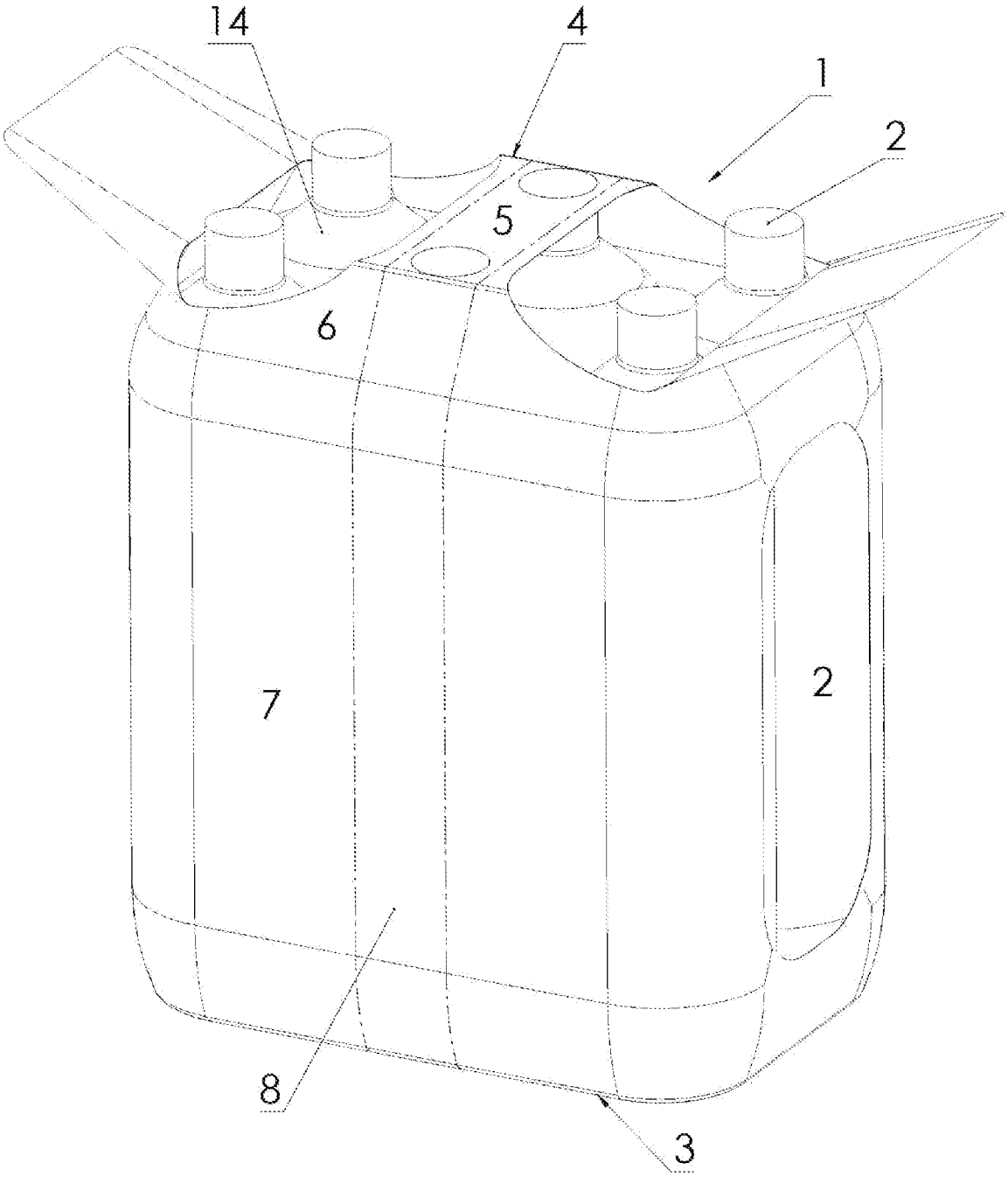
FIG. 5 is a perspective view of a shrinkable packaging according to the invention comprising 6 bottles, after the perforations located in the central area and the perforations located in the peripheral area have been broken.
Figure 6:
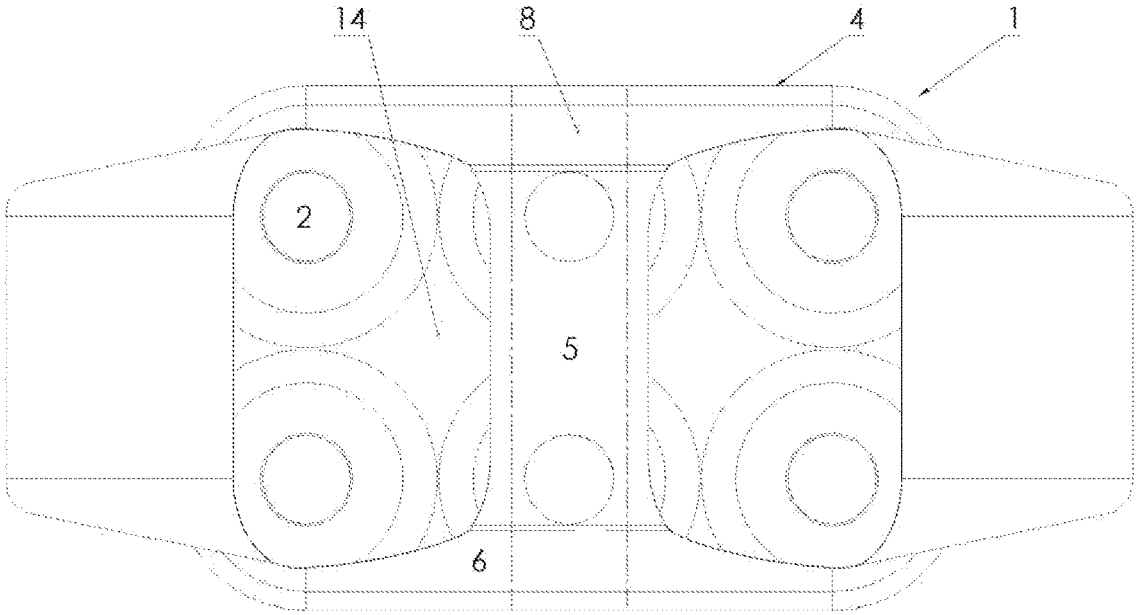
FIG. 6 is a top view of the shrinkable packaging of FIG. 5.

The two perforation lines 9*a*, 9*b* of the shrinkable packaging 1, in the peripheral area 6 of the upper portion 4, progressively diverge from the reinforcement strip 8. When broken, this particularly advantageously makes it possible to provide a shrinkable packaging 1 comprising a second opening 14 and therefore a guided and facilitated opening system for the removal of the containers 2 from the packaging 1 (see FIGS. 5 and 6).

In the example shown, the two perforation lines 9*a* and 9*b* are each interrupted by at least one imperforate gap 10, shown by a solid line bracket, having a predetermined length. This imperforate gap 10 facilitates the opening in two distinct steps with more resistance between the two steps to avoid accidental complete opening.

Indeed, the first opening step 13 comprises breaking the two perforation lines 9*a* and 9*b* located on the central area 5 of the upper portion 4 of the packaging 1, creating the handle of the packaging 1 for easier movement.

The second opening step 14 comprises breaking the two perforation lines 9*a* and 9*b* located on the peripheral area 6 of the upper portion 4 of the packaging 1, allowing the packaging 1 to be opened and the containers 2 to be easily removed.

The presence of the imperforate gap 10, located in the embodiment shown at the junction between the central area 5 and the peripheral area 6, makes it possible to create this stop between the two opening steps and avoid accidental complete opening.

The two perforation lines 9*a* and 9*b* have a series of perforations 11 which are spaced apart from each other by at least one space 12 having a predetermined length.

In the example shown, the length of the imperforate gap 10 is at least 1.5 times longer than the length of the space 12 between perforations 11.

The shrinkable packaging 1 shown, after the two perforation lines 9*a* and 9*b* have been completely broken and said second opening 14 allowing for easier removal of the containers 2 has been created, retains a strength and rigidity allowing movement thereof and avoiding complete breaking or tearing of the packaging 1.

Figure 7:
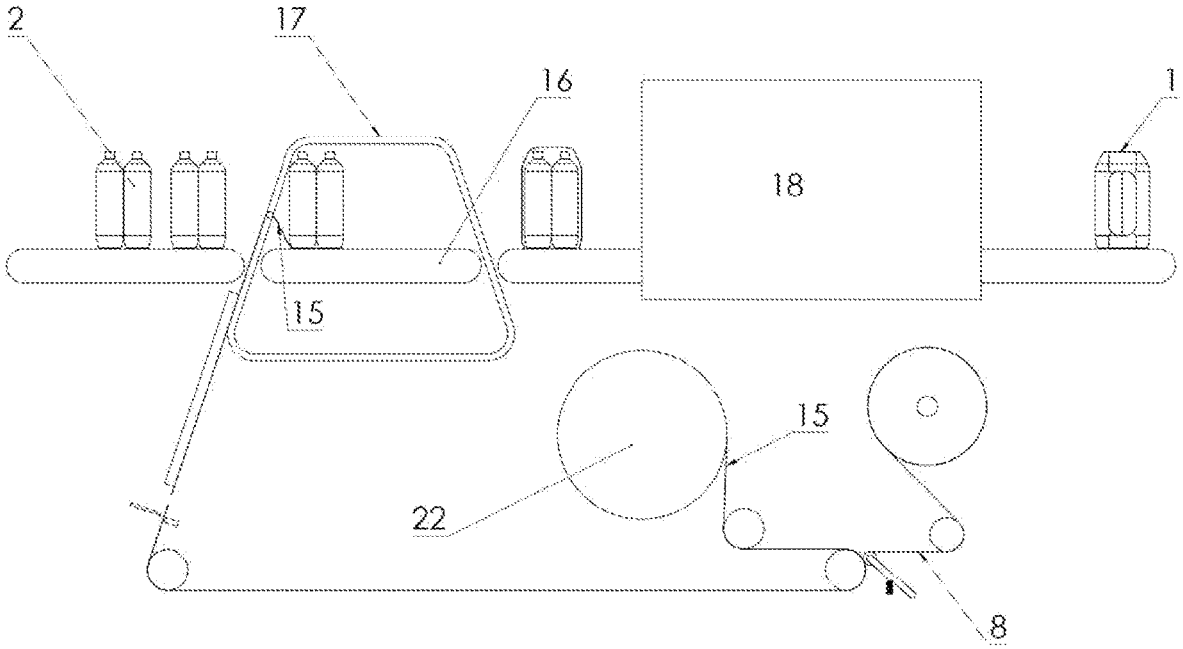
FIG. 7 is a schematic side view of a device for carrying out the method according to the present invention.
Figure 8:
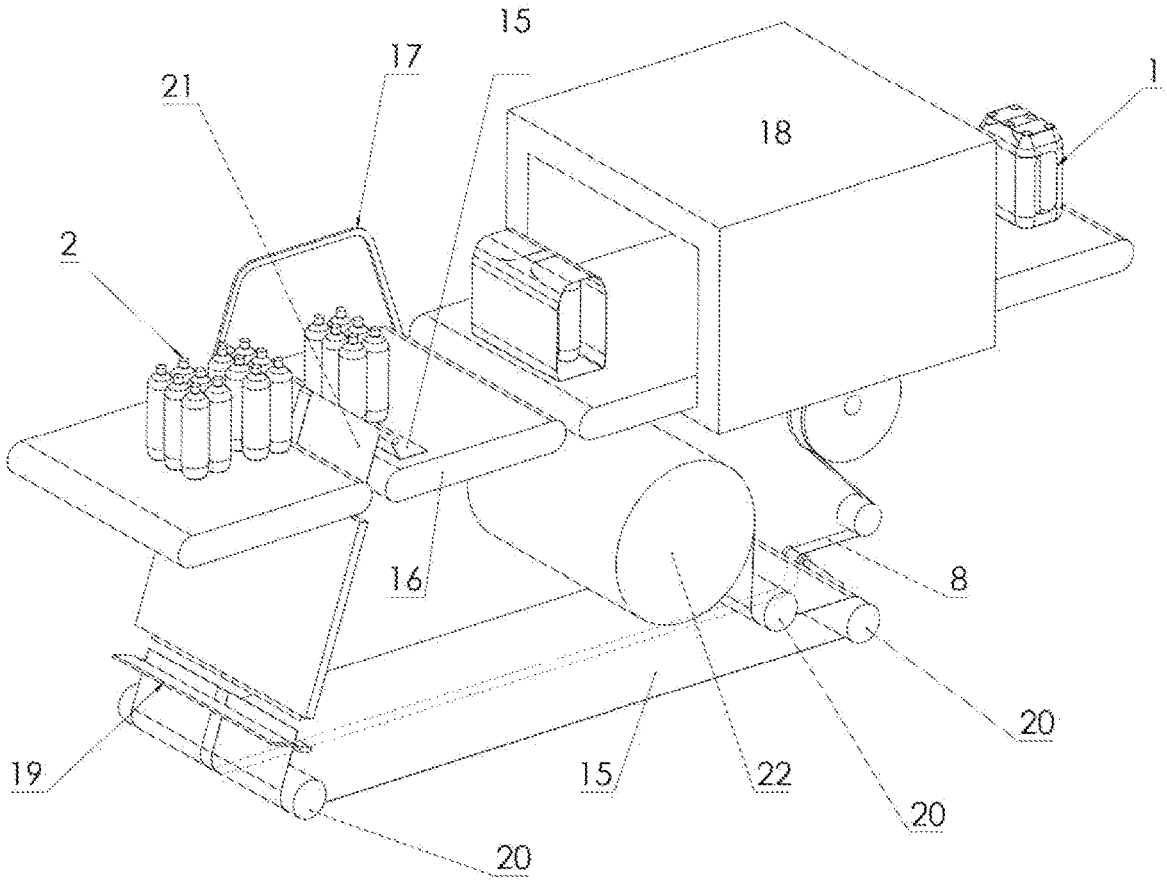
FIG. 8 is a schematic perspective view of the device of FIG. 7.

FIGS. 7 and 8 show a device for carrying out the method for packaging containers by means of a shrinkable packaging 1 according to the present invention.

The method shown currently comprises feeding a shrinkable film 15 onto at least one conveyor belt 16 along a determined direction of movement and arranging the containers 2 on the conveyor belt 16 provided with the shrinkable film 15, the containers 2 being arranged in rows in parallel to one another and the rows being arranged perpendicularly to the determined direction of movement of the film. The feeding step of the method shown comprises unwinding the shrinkable film 15 from a feed roll 22.

The method also comprises shrink wrapping 17 the containers 2 with said shrinkable film 15 forming a shrinkable film 15 packaging around the containers 2, and heat-shrinking 18 the shrinkable film 15 containing the containers 2, to hold them tightly together.

The method according to the invention shown further comprises a step of positioning a reinforcement strip 8 on the shrinkable film 15, in parallel to said film feeding direction of movement.

The step of positioning the reinforcement strip 8 occurs on the shrinkable film 15 before the feeding step, on the surface of the film which will form the inner surface of the shrinkable film 15.

In the example shown, a step of incising at least two perforation lines 9*a*, 9*b* occurs in the shrinkable film 15. In the central area 5 of the upper portion 4 of the packaging 1, the perforations 11 are arranged in parallel to each other on both sides of the reinforcement strip 8. In the peripheral zone 6 of the upper portion 4 of the packaging 1, the perforation lines 9*a*, 9*b* each progressively diverge from the reinforcement strip 8.

The incising step can be performed by any type of machine for forming perforation lines in a film, for example by the machine described in European Patent EP2954990 which is incorporated herein by reference.

In the example shown, the incising step of the method occurs before the feeding step of the shrinkable film 15 and preferably before unwinding the shrinkable film from the feed roll 22, this is thus formed from a rolled perforated shrinkable film 15.

Figure 9:
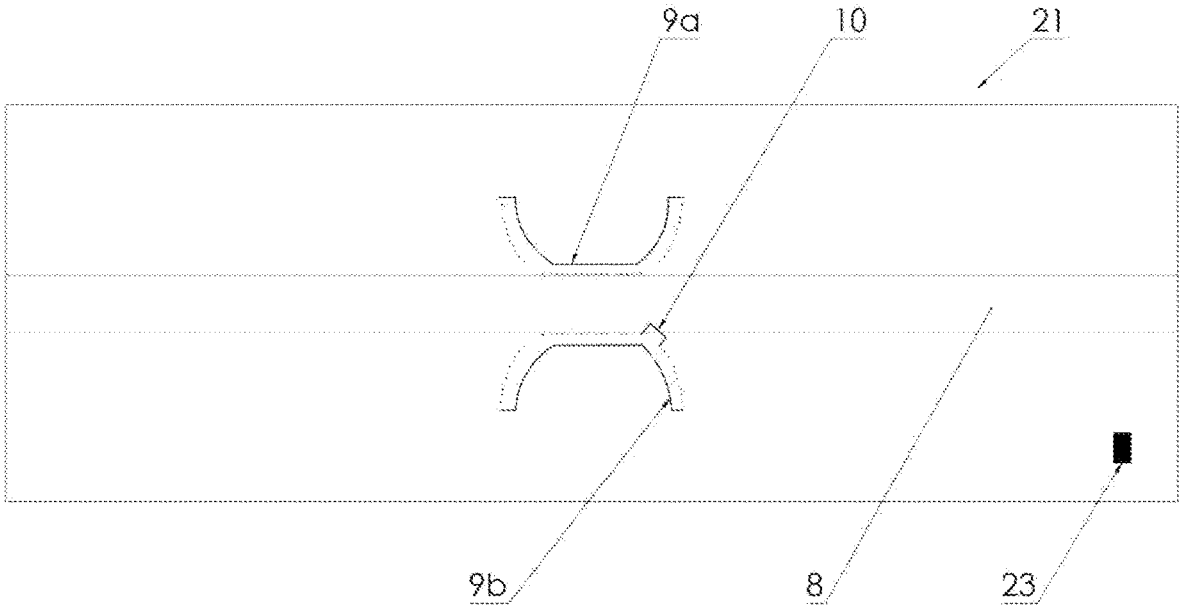
FIG. 9 is a top view of the packaging blank according to the present invention.

In the example shown, a step of cutting by a cutting element 19 is provided to cut the rolled shrinkable film 15 from the feed roll, such as to form an individual packaging blank 21 (as shown in FIG. 9) intended to form the shrinkable packaging 1. The packaging blank 21 shown also comprises a marker 23, used as an indication for the cutting by the cutting element 19 of the film unwound into the packaging blank 21.

The cutting step occurs after positioning the reinforcement strip 8 and before the feeding step.

Furthermore, the method according to the present invention comprises at least one step of printing at least one pattern onto the film 15 before and/or after unwinding the shrinkable film 15.

The printing step in the method according to the invention occurs before and/or after the step of incising the shrinkable film 15. Furthermore, the device shown comprises at least one support element 20, in order to direct the unwound shrinkable film 15. It also comprises at least one cutting element 19 for cutting the unwound shrinkable film 15, before the shrink wrapping step 17 into an individual packaging blank 21 for forming the shrinkable packaging 1.

It is understood that the present invention is in no way limited to the embodiments described above and many modifications can be made without departing from the scope of the appended claims.

The invention claimed is:

1. A method for packaging containers (2) by a shrinkable packaging (1) intended for wrapping a series of containers (2), comprising:

a lower portion (3) corresponding to a base, an upper portion (4), opposite said lower portion (3) and corresponding to a covering of said containers (2) which are arranged in parallel rows with respect to each other, said upper portion (4) comprising a central area (5) and a peripheral area (6), lateral portions (7) connecting the lower portion (3) to the upper portion (4), a reinforcement strip (8) arranged transversely to the parallel rows of containers (2), and at least two perforation lines (9*a*, 9*b*) which, in the central area (5) of the upper portion (4) of the packaging (1), are arranged in parallel to each other on both sides of the reinforcement strip (8), and which, in the peripheral area (6) of the upper portion (4) of the packaging (1), each of the at least two perforation lines progressively diverges from the reinforcement strip (8);

wherein the method comprises:

feeding a shrinkable film (15) onto at least one conveyor belt (16) along a determined direction of movement, arranging said containers (2) on said at least one conveyor belt (16) provided with said shrinkable film (15), said containers (2) being arranged in rows in parallel to one another, said rows being arranged perpendicularly to said direction of movement of the film, shrink wrapping (17) said containers (2) with said shrinkable film (15) forming a shrinkable film packaging (15) around said containers (2), heat-shrinking (18) said shrinkable film (15) containing said containers (2), to hold said containers (2) tightly together, positioning a reinforcement strip (8) on said shrinkable film (15), in parallel to said film feeding direction of movement, and incising in said shrinkable film (15) at least two perforation lines (9*a*, 9*b*) which, in the central area (5) of the upper portion (4) of the packaging (1), are arranged in parallel to each other, on both sides of the reinforcement strip (8) and which, in the peripheral area (6) of the upper portion (4) of the packaging (1), each progressively diverge from the reinforcement strip (8).

2. The method according to claim 1, wherein the feeding comprises unwinding the shrinkable film (15) from a feed roll (22) and the positioning of the reinforcement strip (8) occurs on the shrinkable film (15) before said feeding step, on a surface of the film that forms an inner surface of said packaging after shrink wrapping.

3. The method according to claim 2, further comprising at least one step of cutting the shrinkable film which occurs after said positioning of the reinforcement strip (8) and before said feeding step.

4. The method according to claim 1, wherein said incising step occurs before feeding said shrinkable film (15) onto said conveyor belt (16).

5. The method according to claim 4, wherein said incision step occurs before said unwinding of the shrinkable film (15) from said feed roll (22).

6. The method according to claim 1, further comprising at least one step of printing at least one pattern on said film before and/or after said feeding step.

7. The method according to claim 1, wherein said packaging (1) and said reinforcement strip (8)$^{a}$re at least 85% a similar material.

8. The method according to claim 1, wherein said packaging (1) and said reinforcement strip (8)$^{a}$re at least 90% a similar material.

9. The method according to claim 1, wherein said packaging (1) and said reinforcement strip (8) are at least 95% a similar material.

10. The method according to claim 1, wherein said reinforcement strip (8) comprises a tackifier by which it is attached to an inner surface of said shrinkable packaging (1) wrapping the series of containers (2).

11. The method according to claim 1, wherein said packaging (1) and said reinforcement strip (8) are at least 80% a similar material.

12. The method according to claim 1, wherein said at least two perforation lines (9*a*, 9*b*) are each interrupted by at least one imperforate gap (10) having a predetermined length.

13. The method Packaging (1) according to claim 12, wherein said at least two perforation lines (9*a*, 9*b*) have perforations (11) spaced apart from each other by at least one space (12) having a predetermined length, and wherein said at least one imperforate gap (10) is at least 1.5 times longer than said gap (12) between perforations (11).

14. The method according to claim 12, wherein said at least two perforation lines (9*a*, 9*b*) have perforations (11) spaced apart from each other by at least one space (12) having a predetermined length, and wherein said at least one imperforate gap (10) is at least 2 times longer than said gap (12) between perforations (11) preferably at least 2 times longer.

15. The method according to claim 12, wherein said at least two perforation lines (9*a*, 9*b*) have perforations (11) spaced apart from each other by at least one space (12) having a predetermined length, and wherein said at least one imperforate gap (10) is at least 2 times longer than said gap (12) between perforations (11) preferably at least 2.5 times longer.

16. The method according to claim 1, wherein said containers (2) are selected from the group consisting of bottles, tins, jars, cans for liquids, cartons and cans.

17. The method according to claim 1, wherein a row of containers (2) contains two, three or four containers (2).

* * * * *